US005616550A

United States Patent [19]

Kruse et al.

[11] Patent Number: 5,616,550

[45] Date of Patent: Apr. 1, 1997

[54] PROCESS FOR THE CONTINUOUS PRODUCTION OF A GRANULAR DETERGENT

[75] Inventors: Hans-Friedrich Kruse, Korschenbroich; Hans-Josef Beaujean, Dormagen; Thomas Holderbaum, Monheim; Jochen Jacobs, Wuppertal, all of Germany

[73] Assignee: Henkel Kommanditgesellschaft auf Aktien, Duesseldorf, Germany

[21] Appl. No.: 335,810

[22] PCT Filed: May 13, 1993

[86] PCT No.: PCT/EP93/01191

§ 371 Date: Dec. 19, 1994

§ 102(e) Date: Dec. 19, 1994

[87] PCT Pub. No.: WO93/23523

PCT Pub. Date: Nov. 25, 1993

[30] Foreign Application Priority Data

May 21, 1992 [DE] Germany ..... 42 16 774.4

[51] Int. Cl.[6] ..... C11D 11/00

[52] U.S. Cl. ..... 510/444; 510/457; 264/140; 264/117

[58] Field of Search ..... 252/89.1, 174, 252/174.21, 549, 174.23; 264/117, 140; 23/313 R; 510/444, 457

[56] References Cited

U.S. PATENT DOCUMENTS 5,366,652 11/1994 Capeci et al. ..... 252/89.1

FOREIGN PATENT DOCUMENTS

| | | |
|---|---|---|
| 0280223 | 8/1988 | European Pat. Off. . |
| 0339996 | 11/1989 | European Pat. Off. . |
| 0351937 | 1/1990 | European Pat. Off. . |
| 0368137 | 5/1990 | European Pat. Off. . |
| 0367339 | 5/1990 | European Pat. Off. . |
| 0390251 | 10/1990 | European Pat. Off. . |
| 0420317 | 4/1991 | European Pat. Off. . |
| 2568584 | 2/1986 | France . |

*Primary Examiner*—Douglas J. McGinty
*Assistant Examiner*—Lorna M. Douyon
*Attorney, Agent, or Firm*—Ernest G. Szeke; Wayne C. Jaeschke; Real J. Grandmaison

[57] ABSTRACT

A process for the continuous production of a granular detergent composition comprising:

(a) pregranulating at least 40% by weight of a mixture of solid and liquid detergent components, based on the total weight of the solid and liquid cleaning components, in a first low-speed mixer/granulator having mixing tools contained therein, to form a pregranulated detergent mixture; and (b) granulating the pregranulated detergent mixture in a second high-speed mixer/granulator to form a final granular detergent composition.

14 Claims, No Drawings

PROCESS FOR THE CONTINUOUS PRODUCTION OF A GRANULAR DETERGENT

BACKGROUND OF THE INVENTION

1. Field of the Invention

This invention relates to a process for the continuous production of granular detergent and/or cleaning compositions, dust-free and non-greasy granules preferably having an apparent density of 600 to 1000 g/l being obtained through suitably selected process conditions.

2. Discussion of Related Art

Numerous proposals for the batch production or continuous production of compacted granules are known from the prior art. Either high-speed, rapidly rotating mixer/granulators are used or two mixer/granulators are arranged in tandem, the first mixer/granulator being a high-speed, rapidly rotating mixer/granulator and the second mixer/granulator being a low-speed, slowly rotating mixer/granulator. Thus, granulation processes in a high-speed, rapidly rotating mixer/granulator are disclosed, for example, in European patent applications 351 937 and 339 996.

Process in which a high-speed, rapidly rotating mixer/granulator and a low-speed, slowly rotating mixer/ granulator are arranged in tandem are described, for example, in European patent application 420 317 and in European patent application 390 251. According to EP 420 317, anionic surfactants in their acid form are first neutralized in the high-speed mixer/granulator and are then converted into granules with other constituents. These granules are plastic and are deformed in a low-speed mixer/granulator, resulting in compaction of the granules. The process is completed by a drying or cooling step. EP 390 251 describes a two-stage granulation process in which 0.1 to 40% by weight of the solid starting material is added after the first granulation stage (high-speed mixer/granulator) and optionally during the second granulation stage (low-speed mixer/granulator).

One feature common to these known processes is that, although the granules obtained by them have an apparent density of around 600 to 900 g/l, they do tend to cake and to become tacky and greasy unless the processes are carried out in the substantial absence of water and/or in the substantial absence of nonionic surfactants and/or in a certain temperature range. In addition, the required apparent density can only be established to a certain extent.

Accordingly, the problem addressed by the present invention was to provide a process for the continuous production of dust-free and non-greasy, non-caking and non-tacky granular detergents and/or cleaning compositions containing anionic surfactants and nonionic surfactants in substantial quantities. In addition, the process according to the invention would enable both the required apparent density of the granules to be established and granules with a relatively small percentage of coarse particles to be produced.

DESCRIPTION OF THE INVENTION

Accordingly, the present invention relates to a process for the continuous production of a granular detergent and/or cleaning composition of high apparent density by two-stage granulation in two mixer/granulators arranged in tandem, 40 to 100% by weight, based on the total quantity of solid and liquid constituents used, of the solid and liquid constituents being pregranulated in a first low-speed mixer/granulator and the initial granules thus formed in the first stage optionally being mixed with the remaining solid and/or liquid constituents and converted into granules in a second high-speed mixer/granulator, the percentage of granules larger than 2 mm in diameter being less than 25% by weight.

Accordingly, a particular feature of the process according to the invention is that, in contrast to known processes, the first stage of the two-stage granulation process using a low-speed mixer/granulator and a high-speed mixer/granulator is carried out in the low-speed mixer/granulator while the second stage is carried out in the high-speed mixer/granulator, the process conditions in the high-speed mixer/granulator being established in such a way—depending on the requirements the desired granules are expected to satisfy—that the granules formed in the first low-speed mixer/granulator, although not tacky, are still sufficiently plastic to be deformed and compacted. The percentage of coarse particles formed in the first low-speed mixer/granulator can thus be significantly reduced without any need for the coarse particles to be ground or pulverized.

Any mixer/granulators through which the product flows horizontally and in which the product is moved by mixing tools in the mixing compartment may be used as the low-speed mixer/granulator in the first granulation stage. In addition, the granulation process may be accelerated by cutter heads arranged in the lower part of the mixer drum. In these mixer/granulators, granulation can be carried out at peripheral speeds of the mixing tools of 2 m/s to 7 m/s and is preferably carried out at peripheral speeds of 4 m/s to 5 m/s.

Preferred low-speed mixer/granulators are, for example, the plowshare mixers manufactured by the Lödige company (Federal Republic of Germany) and the intensive mixers manufactured by the IMCATEC company (Federal Republic of Germany). The first granulation stage is preferably carried out over a period of 0.5 to 10 minutes, average residence times in the first granulation stage of 1 to 6 minutes being preferred.

Mixer/granulators through which the mixture to be granulated flows vertically and of which the mixing tools may be operated at peripheral speeds of at least about 8 m/s are used as the high-speed mixer/granulator in the second granulation stage. Preferably, the product is transported through a rapidly rotating shaft arranged concentrically in a cylindrical mixing chamber, on which the mixing tools are mounted in the form of mixing blades or beaters, along the walls of the mixing chamber to the mixer exit in the form of an annular layer extending spirally downwards at a peripheral speed of the mixing tools of 8 m/s to 35 m/s and preferably at peripheral speeds of 12 m/s to 30 m/s. A suitable high-speed mixer/granulator is, for example, the annular layer mixer manufactured by the Schugi company (Netherlands). The second granulation stage is generally carried out in a far shorter time than the first granulation stage, for example in up to 30 seconds. Preferred granulation times in the second granulation stage are 0.1 to 10 seconds and, more particularly, 0.5 to 2 seconds.

The sequence of the granulation steps according to the invention (granulation first in a low-speed mixer/ granulator and then in a high-speed mixer/granulator) enables virtually any desired apparent density between 600 and 1100 g/l to be established through the choice of the process conditions and through the manner in which the liquid components are divided between the two granulation stages. The parameter of the first granulation stage, by whose variation the apparent density can be influenced, is the energy input into the mixture to be granulated, a high energy input being obtained through long residence times and through the number and rotational speed of the cutter heads to be used. Heavy granules are obtained by high energy inputs. The same applies to the second granulation stage, in which the peripheral speeds of the mixing tools and the energy input are increased by increasing the rotational speeds of the mixer shaft, leading to an increase in apparent density in addition to the size reduction of coarse particles. Another parameter through which the apparent density can be varied at least slightly, for example by about 30 to 80 g/l and, more particularly, by up to 60 g/l, is the temperature of the initial granules (i.e. the granules obtained in the first granulation stage) on entry into the second granulation stage. Temperatures of the initial granules of at most 90° C. are preferred, temperatures of 30° to 60° C. being particularly preferred, relatively high temperatures as opposed to relatively low temperatures leading to reductions in apparent density of the order mentioned above.

The most important parameter for establishing apparent density is the addition of the liquid constituents which, at the same time, serve as granulation liquid and which may be added as required only in the first low-speed mixer/granulator or partly in the low-speed mixer/ granulator and partly in the high-speed mixer/granulator. The sole addition of granulation liquids in the first low-speed mixer/granulator generally leads to relatively high apparent densities, for example in the range from 800 to 950 g/l, whereas to establish relatively low apparent densities, for example in the range from 600 to 800 g/l, it is advisable to add part of the granulation liquid in the second high-speed mixer/ granulator. For example, for a special formulation, granules with an apparent density of around 850 g/l were obtained by adding all the granulation liquid in the first mixer/ granulator. Granules with an apparent density of 680 g/l were obtained for the same formulation by addition of 8% by weight of the granulation liquid, based on the total quantity of constituents used, in the second high-speed mixer/granulator. Granules with an apparent density of 600 g/l to 570 g/l were obtained for the same formulation by adding 8.5% by weight to 10.5% by weight of the granulation liquid in the second mixer.

In the same way as the liquid constituents can be partly added in the high-speed mixer/granulator, the solid constituents may also be partly added in the high-speed mixer/ granulator—either on their own or in addition to part of the granulation liquid. In general, apparent density can be increased by the addition of solids, more particularly fine-particle solids, such as zeolite powder, for example Wessalith P® (a product of Degussa AG, Federal Republic of Germany), sodium sulfate or sodium carbonate, in the second mixer/granulator. In addition, solids may be added in the second granulation stage to improve the subsequent processability of the granules and the flow properties of the final granules.

Overall, it is preferred to pregranulate 40 to 100% by weight, preferably 60 to 100% by weight and more preferably up to 95% by weight of the solid and liquid constituents in the first mixer/granulator, to mix the granules obtained with 0 to 60% by weight and preferably with 5 to 40% by weight of remaining solid and/or liquid constituents in the second mixer/granulator and finally to convert the initial granules into the final, but not yet dried and, hence, possibly still moist granules.

The solid constituents may be introduced into the process in powder form or as granules which have been obtained by granulation or spray drying and which have an apparent density of, for example, 200 to 600 g/l. The powders are normally individual components, for example zeolite, sodium carbonate, tripolyphosphate, waterglass or sodium sulfate while the granules preferably contain several components, mostly even minor components and liquid starting materials. It is possible to use only powders or even only granules.

However, part of the constituents used for granulation in the first mixer/granulator, preferably 10 to 100% by weight and more preferably 40 to 100% by weight, based on the solid constituents used in the first mixer/granulator, are preferably used in the form of granules. It has proved to be of particular advantage to use 10 to 40% by weight and, more particularly, up to 30% by weight, based on the overall formulation of the granules, of preferably spray-dried granules.

In principle, any known solid ingredients of detergents and/or cleaning compositions may be used as the solid constituents. Preferred solid constituents are anionic surfactants, builders, alkaline and neutral salts, bleaches and redeposition inhibitors.

Preferred surfactants of the sulfonate type are $C_{9-13}$ alkyl benzenesulfonates, olefin sulfonates, i.e. mixtures of alkene and hydroxyalkanesulfonates, and also disulfonates obtained, for example, from $C_{12-18}$ monoolefins with a terminal or internal double bond by sulfonation with gaseous sulfur trioxide and subsequent alkaline or acidic hydrolysis of the sulfonation products. Alkanesulfonates obtained from $C_{12-18}$ alkanes, for example by sulfochlorination or sulfoxidation and subsequent hydrolysis or neutralization, are also suitable.

Other preferred anionic surfactants are the salts of alkylsulfosuccinic acid, which are also known as sulfosuccinates or sulfosuccinic acid esters and which are monoesters and/or diesters of sulfosuccinic acid with alcohols, preferably fatty alcohols and, more preferably, ethoxylated fatty alcohols. Preferred sulfosuccinates contain $C_{8-18}$ fatty alcohol components or mixtures thereof. Particularly preferred sulfosuccinates contain a fatty alcohol component derived from ethoxylated fatty alcohols which, on their own, represent nonionic surfactants (for a description, see below). Of these sulfosuccinates, those of which the fatty alcohol components are derived from ethoxylated fatty alcohols with a narrow homolog distribution are particularly preferred.

The esters of α-sulfofatty acids (ester sulfonates), for example the α-sulfonated methyl esters of hydrogenated coconut oil, palm kernel oil or tallow fatty acids, are also suitable.

Suitable surfactants of the sulfate type are the sulfuric acid monoesters of primary alcohols of natural and synthetic origin, more particularly fatty alcohols, for example coconut oil fatty alcohol, tallow fatty alcohol, oleyl alcohol, lauryl, myristyl, cetyl or stearyl alcohol, or the $C_{10-20}$ oxoalcohols and those of secondary alcohols with the same chain length. The sulfuric acid monoesters of alcohols ethoxylated with 1 to 6 moles of ethylene oxide, such as 2-methyl-branched $C_{9-11}$ alcohols containing an average of 3.5 moles of ethylene oxide, are also suitable. Fatty alcohol mixtures which may additionally contain unsaturated alcohols, for example oleyl alcohol, are also preferred. Mixtures in which 50 to 70% by weight of the alkyl groups are $C_{12}$ alkyl groups, 18 to 30% by weight $C_{14}$ alkyl groups, 5 to 15% by weight $C_{16}$ alkyl groups, less than 3% by weight $C_{10}$ alkyl groups and less than 10% by weight $C_{18}$ alkyl groups are preferably used.

Other suitable anionic surfactants are, in particular, soaps, preferably in quantities of 0.5 to 8% by weight. Suitable soaps are saturated fatty acid soaps, such as the salts of lauric acid, myristic acid, palmitic acid or stearic acid, and soap mixtures derived in particular from natural fatty acids, for example coconut oil, palm kernel oil or tallow fatty acids. Soap mixtures of which 50 to 100% by weight consist of saturated $C_{12-18}$ fatty acid soaps and 0 to 50% by weight of oleic acid soap are particularly preferred.

The anionic surfactants may be present in the form of their sodium, potassium or ammonium salts and as soluble salts of organic bases such as mono-, di- or triethanolamine. The anionic surfactants are preferably present in the form of their sodium or potassium salts, more particularly in the form of their sodium salts.

The anionic surfactants are preferably used in quantities of 3 to 25% by weight and, more preferably, in quantities of 10 to 20% by weight, based on the sum total of the constituents used. However, they may also be used in quantities of more than 15% by weight. Preferred anionic surfactants are fatty alkyl sulfates, alkyl benzenesulfonates, sulfosuccinates and mixtures thereof, such as mixtures of fatty alkyl sulfates and sulfosuccinates or fatty alkyl sulfates and fatty alkyl benzenesulfonates, more particularly in combination with soap. It is particularly preferred to use at least part of the sulfonate and/or sulfate surfactants in liquid rather than solid form as part of the granulation liquid.

Suitable builders are, above all, the known zeolites and phosphates, more particularly tripolyphosphates. The builders are preferably used in quantities of 20 to 60% by weight and, more particularly, 20 to 50% by weight, based on the sum total of the constituents used and expressed as anhydrous active substance.

The finely crystalline, synthetic zeolite containing bound water used in accordance with the invention is preferably detergent-quality zeolite NaA. It is preferably used in the form of a spray-dried powder. Preferred zeolites have an average particle size of less than 10 μm (volume distribution, as measured with a Coulter Counter) and preferably contain 20 to 22% by weight of bound water.

Useful organic builders are, for example, polycarboxylic acids preferably used in the form of their sodium salts, such as citric acid, succinic acid, glutaric acid, adipic acid, tartaric acid and nitrilotriacetic acid (NTA), providing there are no ecological objections to their use, and mixtures thereof.

Polymeric polycarboxylates may be used as other organic builders.

Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and of acrylic or methacrylic acid with maleic acid. Copolymers of acrylic acid with maleic acid containing 50 to 90% by weight of acrylic acid and 50 to 10% by weight of maleic acid have proved to be particularly suitable. Particularly preferred copolymers are those containing 60 to 85% by weight of acrylic acid and 40 to 15% by weight of maleic acid. Their relative molecular weight, based on free acids, is generally in the range from 5,000 to 200,000, preferably in the range from 10,000 to 120,000 and more preferably in the range from 50,000 to 100,000.

The content of (co)polymeric polycarboxylates in the detergents and/or cleaning compositions is preferably from 0.5 to 8% by weight.

It is particularly preferred to use at least part, preferably 20 to 100% by weight, of the (co)polymeric polycarboxylates used in the form of an approximately 20 to 55% by weight aqueous solution, rather than in solid form, as part of the granulation liquid.

Other suitable builders are polyacetals which may be obtained by reaction of dialdehydes with polyol carboxylic acids containing 5 to 7 carbon atoms and at least 3 hydroxyl groups, for example as described in European patent application 280 223. Preferred polyacetals are obtained from dialdehydes, such as glyoxal, glutaraldehyde, terephthalaldehyde and mixtures thereof, and from polyol carboxylic acids, such as gluconic acid and/or glucoheptonic acid.

Preferred alkaline salts include water-soluble inorganic salts, such as bicarbonates, carbonates, silicates or mixtures thereof; alkali metal carbonate and akali metal silicate, above sodium silicate with a molar ratio of 1:1 to 1:4.5, are particularly preferred. The content of sodium carbonate in the detergents and/or cleaning compositions is preferably up to 20% by weight and advantageously from 1 to 15% by weight. The content of sodium silicate, for example amorphous or crystalline sodium disilicate, in the detergents and/or cleaning compositions is generally up to 10% by weight and preferably between 2 and 8% by weight.

If sulfates are used, they are preferably used in quantities of 15 to 40% by weight, based on the final granules. However, processes in which no sulfate is used are preferred.

Among the compounds yielding $H_2O_2$ in water which are used as bleaches, sodium perborate tetrahydrate and sodium perborate monohydrate are of particular importance. Other useful bleaches are, for example, sodium percarbonates, peroxypyrophosphates, citrate perhydrates and $H_2O_2$-yielding peracidic salts or peracids, such as perbenzoates, peroxyphthalates, diperazelaic acid or diperdodecanedioic acid. The content of bleaches in the detergents and/or cleaning compositions is preferably from 5 to 25% by weight and, more preferably, from 10 to 20% by weight, based on the final granules. The bleaches may be added either in the granulation process according to the invention or in a following processing step. Where bleaches, preferably perborates and percarbonate, are used in the two-stage granulation process according to the invention, they are preferably added in the second granulation stage in which the temperature of the granules should not exceed 70° C. If necessary, this may be achieved by cooling.

The function of redeposition inhibitors is to keep the soil detached from the fibers suspended in the liquor and thus to prevent discoloration. Suitable redeposition inhibitors are generally organic water-soluble colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides bearing acidic groups are also suitable for this purpose. Soluble starch preparations and other starch products than those mentioned above, for example degraded starch, aldehyde starches, etc., may also be used. However, preferred redeposition inhibitors are carboxymethyl cellulose, methyl cellulose, methyl hydroxyethyl cellulose and mixtures thereof and also polyvinyl pyrrolidone, optionally in admixture with the cellulose derivatives; these redeposition inhibitors are preferably used in quantities of 0.1 to 5% by weight and, more preferably, in quantities of up to 3% by weight.

Granulation of the solid constituents requires a granulation liquid which either consists solely of pure liquid constituents or mixtures thereof or which contains the solid constituents in dissolved and/or suspended form. The granulation liquid is preferably used in quantities of 5 to 30% by weight, based on the total quantity of constituents used. All the granulation liquid may be added in the first mixer/granulator. Alternatively, the granulation liquid may be partly added in the first mixer/granulator and partly in the second mixer/granulator. Depending on the required apparent density, 0 to 20% by weight and preferably up to 10% by weight, based on the total quantity of constituents used, of granulation liquid is preferably added in the second high-speed mixer/granulator. The granulation liquid preferably consists of liquid constituents of detergents and/or cleaning compositions or of water, of aqueous solutions and/or of mixtures containing aqueous solutions of basically solid constituents and liquid constituents of detergents and/or cleaning compositions.

Liquid constituents of detergents and/or cleaning compositions include in particular nonionic surfactants which are present in liquid, i.e. pumpable and flowable, form at the process temperature. These nonionic surfactants preferably include addition products of 1 to 12 moles of ethylene oxide with primary $C_{12-18}$ fatty alcohols and mixtures thereof, such as coconut oil, tallow or oleyl alcohol, or with 2-methyl-branched primary alcohols (oxoalcohols). More particularly, $C_{12-18}$ alcohols containing 3 EO or 4 EO, $C_{9-11}$ alcohols containing 7 EO, $C_{12-18}$ alcohols containing 3 EO, 5 EO, 7 EO and mixtures thereof, such as mixtures of $C_{12-14}$ alcohol containing 3 EO and $C_{12-18}$ alcohol containing 5 EO, are used as the nonionic surfactants.

The degrees of ethoxylation mentioned above are statistical mean values which, for a special product, may be a whole number or a broken number. Preferred alcohol ethoxylates have a narrow homolog distribution (narrow range ethoxylates, NRE).

The content of ethoxylated fatty alcohols in the final granules is preferably from 5 to 15% by weight. In one preferred embodiment, the liquid nonionic surfactants may be used in admixture with lower polyalkylene glycols derived from linear or branched glycols containing 2 to 6 carbon atoms. Preferred lower polyalkylene glycols are polyethylene glycols or polypropylene glycols with relative molecular weights of 200 to 12,000 and, more particularly, in the range from 200 to 4,000, for example up to 2,000. The ratio by weight of liquid nonionic surfactant to lower polyalkylene glycol in these mixtures is preferably 10:1 to 1:1.

Other preferred water-containing mixtures are water-containing alkyl glycoside pastes in which alkyl glycosides with the general formula $RO(G)_x$ are used. In this formula, R is a primary, linear or 2-methyl-branched aliphatic radical containing 8 to 22 and preferably 12 to 18 carbon atoms and G stands for a glycose unit containing 5 or 6 carbon atoms, preferably glycose. The degree of oligomerization x, which indicates the distribution of monoglycosides and oligoglycosides, is a number of 1 to 10 and preferably a number of 1.2 to 1.4.

Other preferred aqueous solutions are the already mentioned solutions of (co)polymeric polycarboxylates. They are preferably added in the first low-speed mixer/ granulator to obtain heavy granules. A reduction in apparent density may preferably be achieved by adding this solution in the second high-speed mixer/granulator.

Pumpable aqueous suspensions of zeolites preferably containing stabilizers for these suspensions may advantageously be used in the first low-speed mixer/granulator. It is also particularly preferred to use concentrated aqueous anionic surfactant solutions and anionic surfactant pastes. These are preferably prepared by neutralization of the anionic surfactants in their acid form with high concentrated aqueous alkalis, for example a 45 to 55% by weight sodium hydroxide, in a commercial rotor/stator machine, for example a Supraton®, or in a stirred tank. In a particularly preferred embodiment, nonionic surfactants are additionally used and are preferably used in such quantities that the viscosity of the anionic surfactant pastes is reduced, thus improving their processability, more particularly their pumpability and flowability. These mixtures have a pH value of at least 7.0 and preferably in the range from 7.5 to 12 and are added as constituents of the granulation liquid either in the first or in the second mixer/granulator. 8 to 20% by weight and 10 to 18% by weight, based on the total quantity of constituents used, of these anionic surfactant/nonionic surfactant mixtures are preferably added in the first low-speed mixer/granulator.

The two-stage granulation process may be followed by a drying stage. This is not necessary if the granulation liquid is free from water or is not absolutely necessary if the granulation liquid contains only small quantities of water, for example up to 12% by weight, based on the total quantity of the constituents used. The quantity of water which can be tolerated without drying depends to a large extent on the particular overall composition. However, if the granulation liquid does contain water, irrespective of the quantity, the following drying step is preferred. The drying step is carried out in particular in a fluidized bed with inflowing air temperatures below 180° C. The granulation liquid preferably contains water in only such a quantity that at most 15% by weight, based on the total quantity of constituents used, of water evaporates under these conditions.

The continuous process according to the invention is distinguished not only by the fact that it enables granules with a certain apparent density to be produced as required, but also by the fact that the granules obtained are distinguished by a very uniform particle size distribution with a minimal percentage of coarse particles, the percentage of granules larger than 2 mm in diameter and, in particular, larger than 1.6 mm in diameter preferably being at most 12% by weight and, more preferably, at most 10% by weight (sieve analysis). These outstanding properties are obtained in particular when the first mixer/granulator is filled to a level of 10 to 80% and preferably 20 to 70% and the second mixer/ granulator is operated at high peripheral speeds of around 25 m/s to around 30 m/s.

Any coarse particles present, i.e. granules larger than 2 mm and preferably larger than 1.6 mm in diameter, are preferably removed by sieving and may advantageously be returned to the continuous production process after size reduction, for example in a mill. It is preferred to return the size-reduced coarse particles to the sieve and hence to mix them with other granules of the required size. Size-reduced coarse granules or even fine granules, i.e. granules smaller than 0.1 mm in diameter, may also be returned in each granulation stage.

The granules obtained by the process according to the invention may be directly used as detergents and/or cleaning compositions and/or may be sprayed in known manner with further quantities, preferably small quantities, for example 2 to 10% by weight, based on the total quantity of constituents used, of liquid nonionic surfactants or nonionic surfactant mixtures and/or may be mixed with other constituents, preferably granular and, more preferably, granular and compacted constituents of detergents and cleaning compositions, in a subsequent processing step. These other granular constituents include, for example, compacted bleach or bleach activator granules, enzyme granules, foam inhibitor granules, preferably concentrated foam inhibitor granules, and granular carriers for dyes and fragrances.

Suitable bleach activators are, for example, N-acyl or O-acyl compounds which form organic peracids with $H_2O_2$, preferably N,N'-tetraacylated diamines, and also carboxylic anhydrides and esters of polyols, such as glucose pentaacetate. The content of bleach activators in bleach-containing detergents and/or cleaning compositions is in the typical range, preferably from 1 to 10% by weight and more preferably from 2 to 8% by weight. Particularly preferred bleach activators are N,N,N', N'-tetraacetyl ethylenediamine (TAED) and 1,5-diacetyl-2,4-dioxohexahydro-1,3,5-triazine (DADHT).

Suitable enzymes are enzymes from the class of proteases, lipases, amylases, cellulases and mixtures thereof. Enzymes obtained from bacterial strains or fungi, such as Bacillus subtilis, Bacillus licheniformis and Streptomyces griseus, are particularly suitable. Proteases of the subtilisin type, more particularly proteases obtained from Bacillus lentus, are preferably used. They may be used in quantities of around 0.2 to around 2% by weight. The enzymes may be adsorbed onto carriers and/or encapsulated in shell-forming materials to protect them against premature decomposition.

Suitable stabilizers, more particularly for per compounds and enzymes, are for example the salts of polyphosphonic acids, more particularly 1-hydroxyethane-1,1-diphosphonic acid (HEDP).

Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica. Mixtures of various foam inhibitors, for example mixtures of silicones, paraffins or waxes, are also advantageously used. Silicone oils and/or paraffin oils may be added in the two-stage granulation process according to the invention, preferably in the first low-speed mixer/granulator.

Other constituents of detergents include optical brighteners. The detergents and/or cleaning compositions may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazin-6-ylamino) -stilbene-2,2'-disulfonic acid or compounds of similar structure which contain a diethanolamino group, a methylamino group, an anilino group or a 2-methoxyethylamino group instead of the morpholino group. In addition, brighteners of the substituted 4,4'-distyryl diphenyl type, for example the compound 4,4'-bis-(4-chloro-3-sulfostyryl)-diphenyl, may also be present. Mixtures of the brighteners mentioned above may also be used. Particularly uniform white granules are obtained when the detergents and/or cleaning compositions contain small quantities, for example $10^{-6}$ to $10^{-3}$% by weight and preferably $10^{-5}$% by weight, of a blue dye in addition to typical brighteners in typical quantities, for example 0.1 to 0.5% by weight and preferably 0.1 to 0.3% by weight. A particularly preferred dye is Tinolux® (a product of Ciba-Geigy).

The optical brighteners or rather the mixtures of optical brighteners and dye are preferably dissolved in ethoxylated nonionic surfactants and sprayed in known manner onto the granules produced by the process according to the invention.

The advantageous granular detergents and/or cleaning compositions produced in this way have an apparent density of 600 to 1100 g/l, preferably 700 to 950 g/l and, more preferably, 750 to 850 g/l, generally after coarse granules preferably larger than 1.6 mm in diameter have been removed by sieving. Despite possibly large amounts of ethoxylated nonionic surfactants, the granules are non-greasy and dust-free and, after the optional drying step, have a percentage content of granules larger than 1.6 mm in diameter of at most 25% by weight, preferably at most 20% by weight and, more particularly, from 6 to 12% by weight which is removed by sieving and recycled.

The content of anionic and nonionic surfactants in the granules is preferably from 10 to 40% by weight and, more preferably, from 15 to 30% by weight, based on the final granules, while their content of builders is from 20 to 60% by weight and preferably from 25 to 55% by weight, based on the final granules and expressed as anhydrous active substance. More particularly, the final granules have a content of 7 to 15% by weight of nonionic surfactants and a content of 0 to 20% by weight and preferably 0 to 10% by weight of free, i.e. non-chemically bound or non-physically bound, water.

EXAMPLES

EXAMPLE 1

In a Lödige plowshare mixer, 41% by weight of water-containing zeolite NaA (Wessalith P®, a product of Degussa AG, Federal Republic of Germany), 7.01% by weight of sodium carbonate and 28.35% by weight of spray-dried granules with the composition shown below were homogenized at peripheral speeds of the tools of 4 m/s and at a temperature not exceeding 35° C. and sprayed with 7.07% by weight of a 30% by weight aqueous solution of a (co)polymeric polyacrylate (Sokalan CP5®, a product of BASF, Federal Republic of Germany) and with 16.57% by weight of a mixture (neutralizate) of 8.18% by weight of $C_{9-13}$ alkyl benzenesulfonic acid, 2.32% by weight of a 50% by weight aqueous sodium hydroxide and 6.07% by weight of a $C_{12-18}$ fatty alcohol containing 5 ethylene oxide groups (EO). The filling level of the low-speed mixer was around 50%. The residence time of the constituents in the mixer was about 3 minutes. The initial granules were then granulated for at most 1 second in a Schugi annular layer mixer at peripheral speeds of the annular layer of around 30 m/s and at temperatures of 35° C. and dried in a fluidized bed at inflowing air temperatures of 130° C. The non-greasy, free-flowing and dust-free granules obtained had an apparent density of 860 g/l. The percentage content of dried granules larger than 1.6 mm in diameter before sieving was less than 12% by weight.

Particle size distribution (sieve analysis) in % by weight:

| >1.6 mm | >0.8 mm | >0.4 mm | >0.2 mm | >0.1 mm | <0.1 mm |
|---|---|---|---|---|---|
| 9.1 | 28.7 | 32.9 | 26.6 | 2.7 | — |

These granules were mixed with other constituents of detergents and/or cleaning compositions, such as perborate tetrahydrate, bleach activator, foam inhibitor granules, enzyme, nonionic surfactant and optical brightener.

The spray-dried granules used in the low-speed mixer/granulator had the following composition:

10% by weight $C_{9-13}$ alkyl benzenesulfonate, sodium salt
4% by weight $C_{12-14}$ fatty acid soap, sodium salt
2.5% by weight $C_{12-18}$ fatty alcohol · 5 EO -continued

| | |
|---|---|
| 20.0% by weight | polyacrylate, sodium salt (Sokalan CP5 ®) |
| 9.0% by weight | sodium silicate, $Na_2O:SiO_2$ 1:2.0 (?) |
| 42.5% by weight | sodium carbonate |
| 2.0% by weight | 1-hydroxyethane-1,1-diphosphonate, sodium salt |
| Remainder | water, dye, optical brightener |

EXAMPLE 2

Example 1 was repeated. On this occasion, however, the initial granules were prepared without the Sokalan® CP5 solution. Instead, the Sokalan was added in the form of a 30% by weight solution through nozzles during the second granulation step. After drying and sieving, the granules had an apparent density of 720 g/l. The percentage of coarse particles larger than 1.6 mm in diameter was 6% by weight.

EXAMPLE 3

Example 2 was repeated. On this occasion, however, the second granulation step was carried out at peripheral speeds of the annular layer of 17 m/s. After drying and sieving, these granules had an apparent density of 621 g/l. The percentage of coarse particles larger than 1.6 mm in diameter was 21% by weight.

EXAMPLE 4

Example 1 was repeated, the temperature of initial granules on entering the second granulation stage being 48° C. The granules obtained had an apparent density of 830 g/l.

EXAMPLE 5

Example 1 was repeated, the residence time in the first mixer being 4 minutes and the quantity of Sokalan® CP5 solution being reduced to 6% by weight. After drying and sieving to remove 23% by weight-of coarse particles larger than 1.6 mm in size, an apparent density of 930 g/l was obtained.

We claim:

1. A process for the continuous production of a granular detergent composition comprising:

(a) pregranulating for a period of from 0.5 to 10 minutes at least 40% by weight of a mixture of solid and liquid detergent components, based on the total weight of said solid and liquid cleaning components, in a first low-speed mixer/granulator having mixing tools contained therein operating at a peripheral speed of from 4 m/s to 5 m/s to form a pregranulated detergent mixture; and (b) granulating for a period of from 0.1 to 30 seconds said pregranulated detergent mixture in a second high-speed mixer/granulator operating at a peripheral speed of from 12 m/s to 30 m/s to form a final granular detergent composition wherein the percentage of granules having a diameter larger than 2 mm is less than 25% by weight of said composition.

2. The process of claim 1 wherein said pregranulated detergent mixture is added to said second high-speed mixer/granulator at a temperature of from 30° to 60° C.

3. The process of claim 1 wherein from 10 to 100% by weight of said solid detergent components added to said first low-speed mixer/granulator are granules, based on the weight of said solid detergent components.

4. The process of claim 3 wherein from 10 to 40% by weight of said granules are spray-dried granules, based on the weight of said solid detergent components.

5. The process of claim 1 wherein from 40 to 100% by weight of said solid and liquid detergent components are pregranulated in step (a) and subsequently mixed with 0 to 60% by weight of said solid and liquid detergent components in step (b).

6. The process of claim 1 wherein from 5 to 30% by weight of said solid and liquid detergent components of step (a), based on the total weight of said solid and liquid detergent components, are liquid detergent components.

7. The process of claim 6 wherein said liquid detergent components contain solid detergent components in dissolved or suspended form.

8. The process of claim 1 wherein said liquid detergent components have a pH of at least 7.0 and are selected from the group consisting of aqueous anionic surfactants, aqueous nonionic surfactants, and mixtures thereof.

9. The process of claim 1 wherein from 0 to 20% by weight of said liquid detergent components, based on the total weight of said solid and liquid detergent components, are added to said pregranulated detergent mixture in step (b).

10. The process of claim 9 wherein said liquid detergent components added to said pregranulated detergent mixture in step (b) are selected from the group consisting of aqueous anionic surfactants, aqueous nonionic surfactants, aqueous polymeric polycarboxylates, and mixtures thereof.

11. The process of claim 1 wherein said first low-speed mixer/granulator is filled to from 10 to 80% of its holding capacity with said solid and liquid detergent components, and said second high-speed mixer/granulator is operated at a peripheral speed of from about 25 to 30 m/s.

12. The process of claim 1 including drying said granular detergent composition in a fluidized bed apparatus at a temperature up to 180° C.

13. The process of claim 12 wherein up to 15% by weight of water, based on the total weight of said solid and liquid detergent components, is evaporated during said drying step.

14. The process of claim 1 including mixing said granular detergent composition with additional detergent composition components.

* * * * *